United States Patent [19]

Sabater González

[11] Patent Number: 4,514,010

[45] Date of Patent: Apr. 30, 1985

[54] ARRANGEMENT FOR THE DISTRIBUTION OF PRESSURIZED FLUID TO A SEAT UNIT HAVING A BACKREST

[76] Inventor: Buenaventura Sabater González, Denia 23, Barcelona, Spain

[21] Appl. No.: 487,054

[22] Filed: Apr. 21, 1983

[30] Foreign Application Priority Data

May 6, 1982 [ES] Spain ..... 264.985
Jan. 22, 1983 [ES] Spain ..... 269.906

[51] Int. Cl.[3] ..... A47C 3/00

[52] U.S. Cl. ..... 297/284; 297/460; 297/DIG. 3; 5/446; 5/455

[58] Field of Search ..... 297/DIG. 3, 180, 284, 297/458, 460; 5/454, 455, 456, 446

[56] References Cited

U.S. PATENT DOCUMENTS 3,330,598 7/1967 Whiteside ..... 297/DIG. 3
3,652,126 3/1972 Folling ..... 297/DIG. 3
4,190,286 2/1980 Bentley ..... 5/454 X

FOREIGN PATENT DOCUMENTS 1377311 12/1974 United Kingdom ..... 297/284

*Primary Examiner*—Kenneth Downey
*Attorney, Agent, or Firm*—Staas & Halsey

[57] ABSTRACT

An arrangement for the distribution of pressurized fluid to areas of a seat unit having a backrest comprising a first fluid-containing chamber adaptable to the seat area of the seat unit so as to be adapted to receive, at least in part, the user's weight; one or more inflatable chamber adaptable to the seat unit backrest; and lines communicating between the first chamber and each said backrest chamber. Each line has inserted therein a normally closed valve means provided with an opening means with opening controls positioned in the seat unit such as to be accessible to the user. The invention also relates to an embodiment of said valve.

9 Claims, 7 Drawing Figures

ARRANGEMENT FOR THE DISTRIBUTION OF PRESSURIZED FLUID TO A SEAT UNIT HAVING A BACKREST

FIELD OF THE INVENTION

This invention relates to an arrangement for the distribution of pressurised fluid to areas of a seat unit having a backrest.

STATE OF THE ART

Such seat units are frequently provided with cushioned areas, preferably in the seat and backrest areas. Such cushioned areas provide relative comfort for the user since they allow him to rest on soft areas.

Nevertheless, the capacity of such known seat units to adapt themselves to the user's anatomy is limited.

SUMMARY OF THE INVENTION

To overcome this drawback, it is an object of the invention to provide means notably increasing the capacity of adaptation of the seat unit to the user's anatomy and that such adaptation may be adjusted by the user himself, without requiring any other effort than the user's own weight.

This object is attained by an arrangement of the type described above having a first fluid-containing chamber adaptable to the seat area of the seat unit so as to be adapted to receive at least in part the user's weight; at least one inflatable chamber adaptable to the seat unit backrest and lines communicating between said first chamber and each of the backrest chambers, each of said lines having inserted therein a normally closed valve means provided with opening means having opening controls adapted for being positioned in the seat unit such as to be easily accessible to the user thereof.

By the said arrangement, when the user sits down, there is caused an excess pressure in the first chamber tending to transmit the fluid to the backrest chambers and this fluid transmission is adjustable by the user by way of said valve means.

Preferably according to the invention there are two inflatable chambers in the backrest area, one of them for supporting the user's back and the other for supporting the user's cervical region.

Also according to the invention, said first chamber is resilient and tends to recover and retain its volume in the unstressed state when not subject to the user's weight.

Also according to the invention, the valve means has a valve body provided with two generally oppositely disposed ports of access to the interior thereof, and first and second valve seats.

In accordance with a second object of the invention, the arrangement is provided with means for being mounted removably in the seat unit having a backrest.

In a preferred embodiment, in which the valve means has a valve body with two access ports to the interior thereof, at least one valve seat and a stopper for bearing against each said valve seat, the arrangement is characterised in that the or each valve seat is formed by a resilient washer positioned between the stopper and one of the access ports, while said stopper is made from lightweight material, there being also an opening means associated with each washer forming each valve seat and capable of penetrating from the space opposite that occupied by the stopper in the washer orifice, preventing the stopper from seating against the valve seat, said opening means being partially housed in a sealed tubular member fixedly attached to the valve body, each opening means comprising a filiform member moveable in a longitudinal direction, a resilient member urging it away from the washer orifice and an opening control for causing such longitudinal movement.

BRIEF DESCRIPTION OF THE DRAWINGS

The invention is described hereinafter in further detail with the aid of drawings which illustrate only a preferred embodiment. In the drawings.

DETAILED DESCRIPTION OF THE PREFERRED EMBODIMENTS

Figure 1:
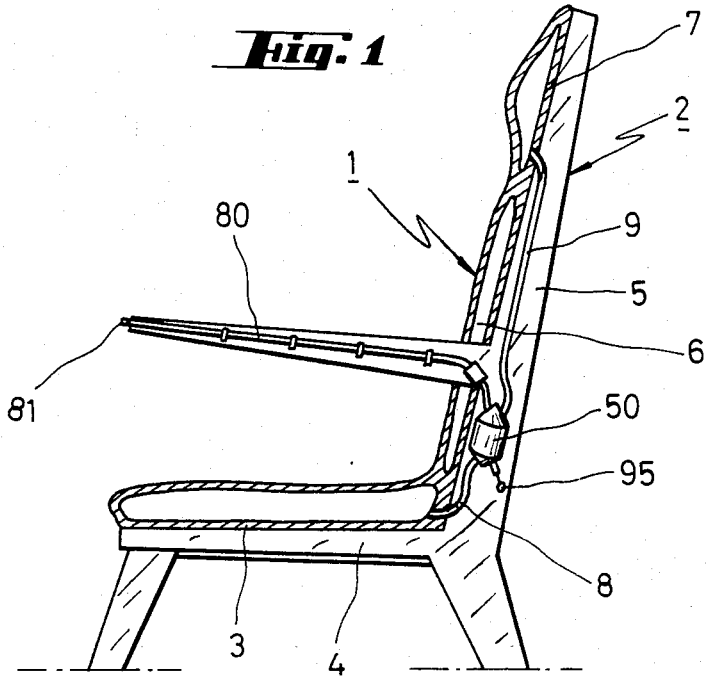
FIG. 1 is a schematic side elevation view of a seat unit in which the legs are shown only in part and which is provided with an arrangement, shown partly in section, for the distribution of pressurised fluid to different areas thereof.
Figure 2:
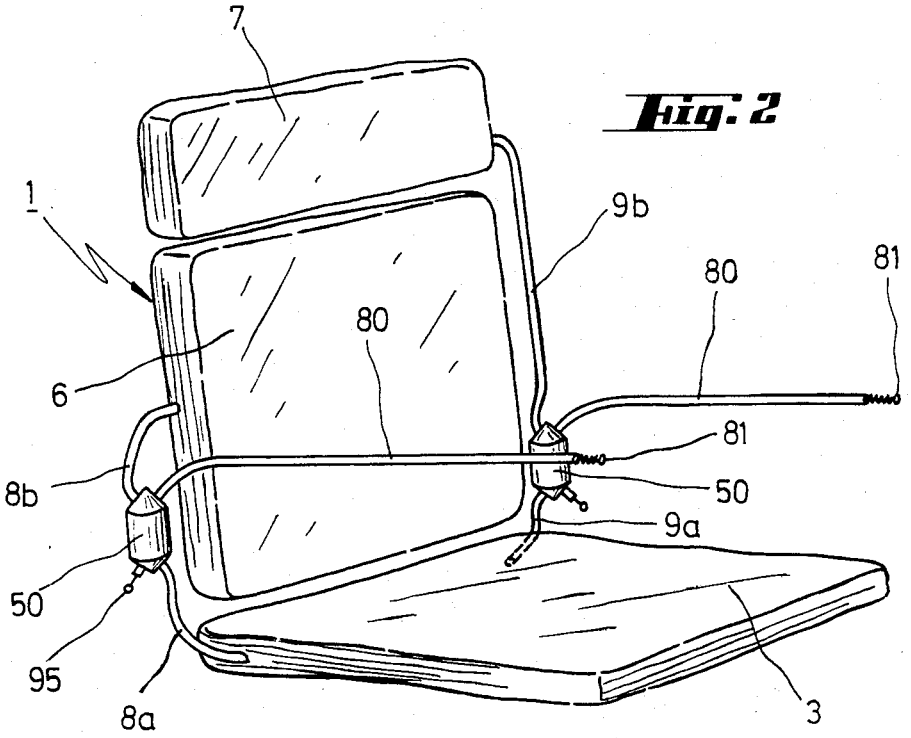
FIG. 2 is a schematic perspective view of one embodiment of the said arrangement.

The arrangement 1 for the distribution of pressurised fluid to areas of a seat unit 2 comprises essentially a first, fluid containing chamber 3 adaptable to the seat area 4 of the seat unit in such a way as to be adapted to receive, at least in part, the weight of the user of the seat unit when sitting thereon. The chamber 3 is resilient and tends to recover and retain its normal volume when not subjected to the user's weight.

Further to the said chamber, there is at least one other chamber positioned in the area 5 of the backrest of the seat unit 2. Preferably this other chamber is formed by two chambers, namely one chamber 6 for supporting the user's back and another chamber 7 for supporting the said user's cervical area. Such chambers may be lined with soft covers and be coated with a upholstery having a certain degree of elasticity.

Said chamber 3 communicates with said chamber 6 over a line 8 having two sections 8*a* and 8*b*. Furthermore, the chamber 3 communicates with the chamber 7 over a line 9 which also has sections 9*a* and 9*b*.

Between each of the said pairs of sections there is inserted a valve means 50 to be described in further detail hereinafter. Said valve means is normally closed to fluid circulation in both directions.

The arrangement also comprises first and second opening means 66 and 84 for each valve means, said opening means being controlled respectively by the button 81 and the knob 95. As will be described hereinafter, when one of the buttons 81 is operated, fluid is allowed to pass from the chamber 3 to the corresponding backrest chamber and such flow is prevented on releasing the button. In turn, when one of the controls 95 is operated, fluid may flow in the reverse direction, namely, from the corresponding backrest chamber to the chamber 3. Nevertheless, in this case it is possible to hold the opening control (the one corresponding to the knob 95) in a position in which it does not prevent the fluid from flowing in the last named direction.

The valve means 50 referred to above comprises a valve body 51 having a preferably cylindrical centre portion 52, a first end portion 53 and a second end portion 54. Said end portions 53, 54 are attached preferably to the centre portion 52 by means of a screw thread and are formed as caps which may be tapered as shown, or may have any other shape such as a rounded shape. Between the end portion 53 and the centre portion 52 there are held a rigid washer 55 and a resilient washer 56; the former is provided with a central orifice having a diameter generally identical to the internal diameter of the centre position 52 and the latter has a central orifice 57 which forms the only communication between the interior of the centre portion 52 and the interior of the end portion 53. In a similar way, between the end portion 54 and the centre portion 52 there are a rigid washer 58 and a resilient washer 59 having a central orifice 60. Between the washers 56, 59 which are generally opposite each other, there is a preferably spherical stopper 61 made from lightweight material and, preferably, hollow. Said washers 56, 59, particularly the edge of the respective central orifices 57, 60, respectively form the first and second valve seats for the stopper 61.

In each end portion 53, 54, there is an access port 62, 63 respectively. The washers 56 and 59 are positioned between these ports and in this sense it is stated that the ports are substantially opposite each other. The ports are provided, respectively, with a neck portion 64, 65, the free end portion of which is provided with a saw-toothed formation for ease of connection to the valve means of communication lines with the chambers.

Figure 4:
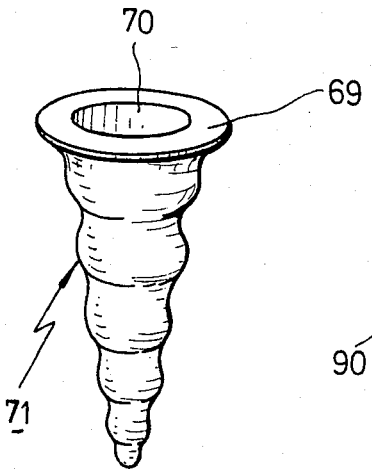
FIG. 4 is a schematic perspective view of the resilient elongate hood member.
Figure 5:
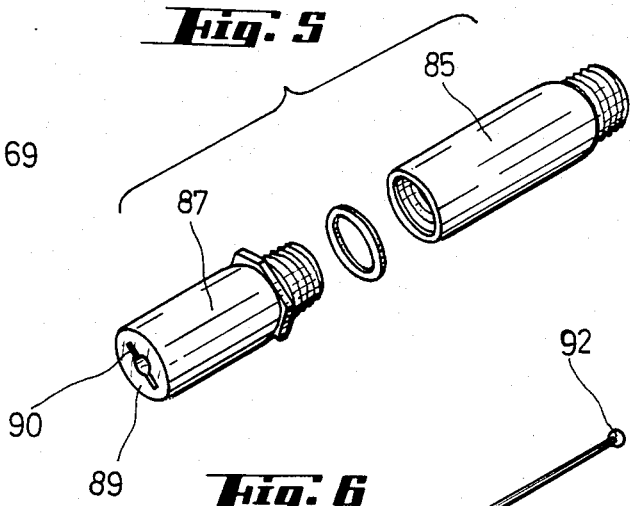
FIG. 5 is an exploded perspective view of the component parts of the second opening means.
Figure 6:
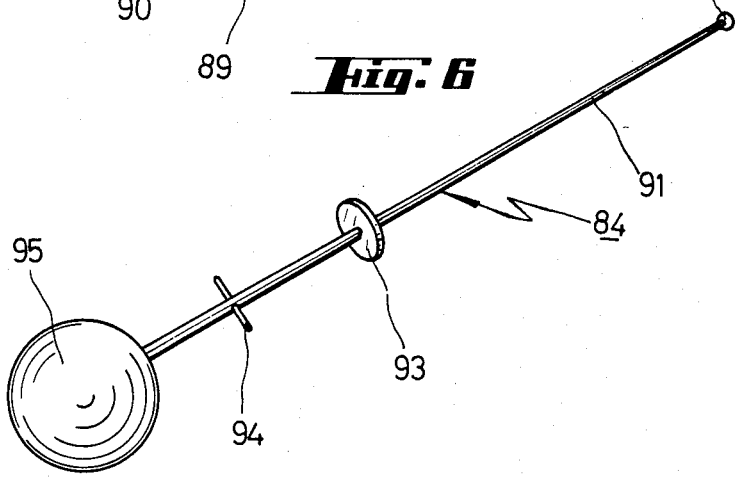
FIG. 6 is a perspective view of the second opening means.
Figure 7:
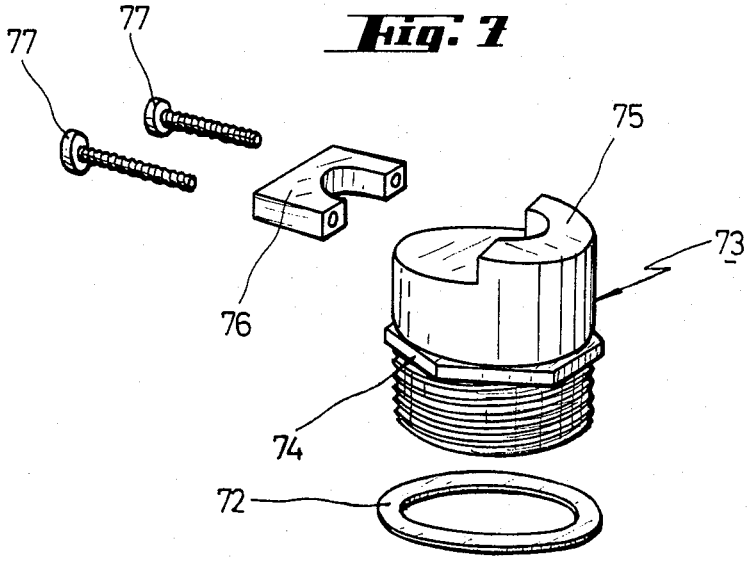
FIG. 7 is an exploded perspective view of the parts forming the plug corresponding to the tubular member partly housing the first opening means.

The first valve seat, formed by the resilient washer 56, is associated with the first opening means or pusher 66 which is partly housed in the interior of a tubular member 67. This tubular member 67 is attached, preferably by a screw thread, to the end portion 53 of the valve body 51. To prevent the loss of pressure between the tubular member 67 and the valve body, there is provided a gasket (not shown). The tubular member 67 is provided with a shoulder 68, on which there seats the flange 69 of the open end 70 of a hood member 71 (FIG. 4) and this flange is applied against a washer 72, pressed on the opposite side thereof by the front end of a perforated plug 73, screwed into the tubular member. Said plug 73 is provided with a hexagonal portion 74 to facilitate the screwing thereof and an axial clamp-like projection 75 adapted to receive a second clamp 76, which may be adjustably attached to the projection 75 by screws 77 which may pass through the clamp 76 and screw into appropriate holes of the projection 75.

The hood member 71 is resilient and elongate and is formed preferably with folds or corrugations to allow for a greater elongation. It is, moreover, impermeable and consequently when mounted inside the tubular member 67 (with the flange 69 trapped between the washer 72 and the shoulder 68) it seals the tubular member 67.

The first pusher means 66 is inserted through the perforation in the plug 73, said pusher means being formed by a cable 78 having preferably a ball end 79 and which, except for the end portions thereof, is inside a sheath 80. One of said end portions, as indicated hereinbefore, is inside the hood 71, whereas in the opposite end portion there is a button 81 which a spring 82 urges away from the end 83 of the sheath 80.

The sheath is properly held between the axial clamp-like projection 75 and the clamp 76 and the cable may be moved longitudinally relative to the sheath 80. Consequently, when pressing the button 81, the cable moves longitudinally, whereby the ball end 79 extends the hood member 71 and the end of the latter crosses through the opening 57, to prevent the stopper 61 from seating against the washer 55 and maintaining therefore the communication between the interior of the valve body 51 and the port 62 open.

On releasing the button 81, the cable is retracted under the urging of the spring 82 and also under the resilience of the hood member 71.

Correspondingly, there is disposed a second opening means or pusher 84, housed partly in the tubular member 85 and associated with the washer 59 which forms the second valve seat.

In a similar way to the tubular member 67, said tubular member 85 is screwed to the end portion 54 of the valve body 51 and there is also a gasket (not shown). The tubular member 85 is also provided with a shoulder 86 and the flange 69 of the opening 70 of a further resilient, elongate hood member 71, as described above, is trapped between the shoulder 89 and a washer. To clamp said washer there is a threaded plug 87. This arrangement provides for a tight seal in a similar way as for the tubular member 67.

The plug 87 is provided with an internal cavity 88 and the free end 89 thereof is provided with a radial slot 90. The pusher means 84 is formed by a rod 91 having a ball end 92, a disc 93 speared by the rod in the centre thereof, a pair of radial arms 94 and a control knob 95. Said rod may rotate relative to the tubular member 85.

The rod 91 is positioned in the tubular member 85 in such a way that the end 92 thereof bears against the end of the hood member 71, the disc 93 is inside the plug 87 and the radial arms 94 are on the outside thereof.

If said arms are aligned with the radial slot 90, and the knob 95 is pushed inwardly, the rod is moved longitudinally, pushes the hood member 71 and the end thereof crosses through the orifice 57 at the same time as the radial arms 94 pass through the slot 90.

Figure 3:
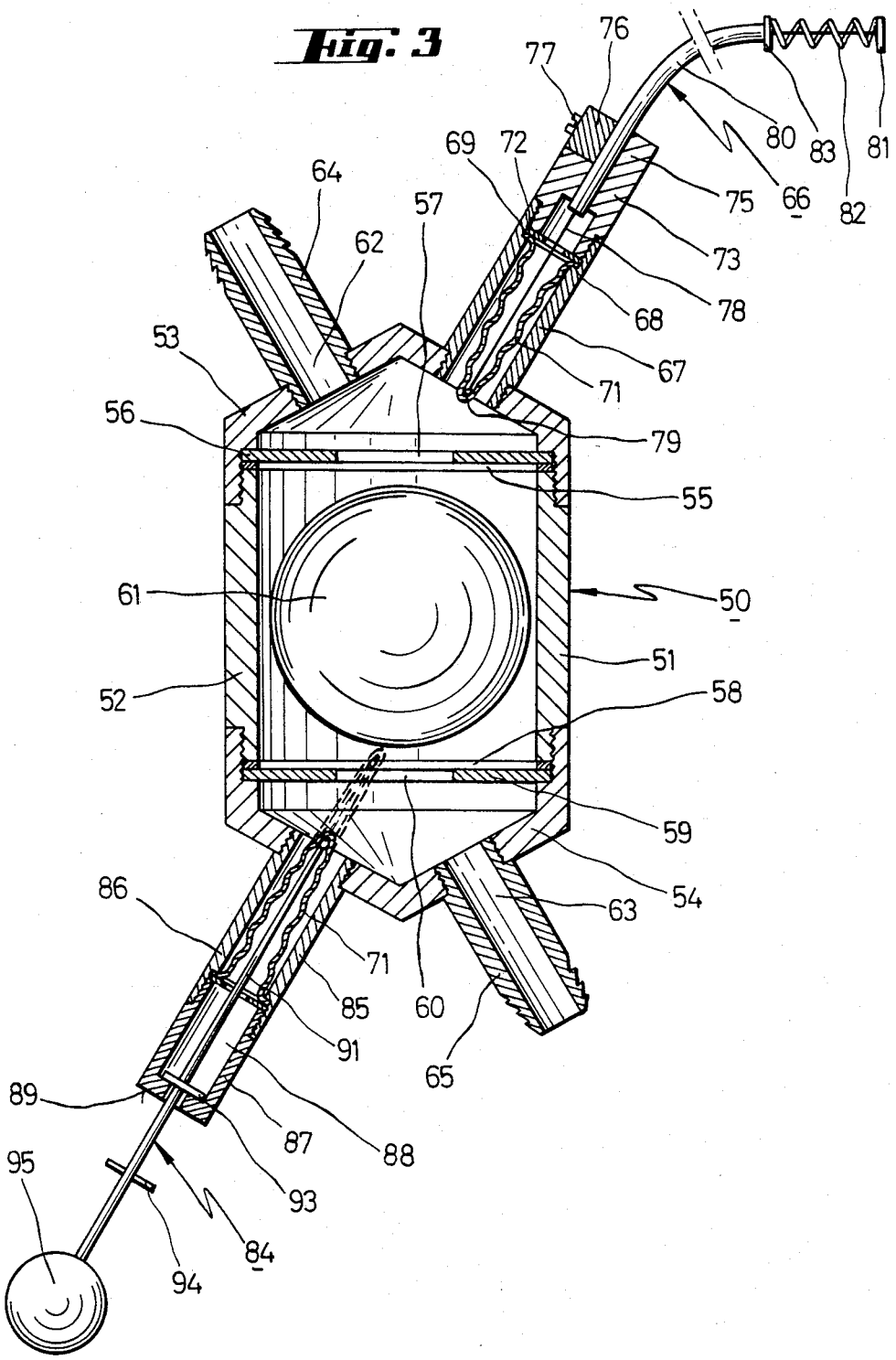
FIG. 3 is an axial cross section view of one embodiment of one of the valve means regulating the distribution of fluid, comprising two valve seats and two opening means.

In this position of the rod 91 (corresponding to the position of the hood member 71 and the end of the rod 91 represented in dash lines in FIG. 3), the stopper 61 is prevented from seating against the washer 59 and therefore the communication between the interior of the valve body 51 and the port 63 is held open. When the force is removed from the knob 95, the resilience of the hood member 71 causes the rod to retract, any action on the stopper being then removed. Nevertheless, if prior to removing the force from the knob 95 the rod 91 is rotated in such a way as to take the radial arms out of alignment with the slot 90, said arms remain within the plug 87 and prevent the retraction of the rod and, therefore, the latter is held in the position to prevent seating of the stopper against the orifice 60 of the washer 59.

The device is installed on a seat unit such that each chamber is located in a corresponding area of the seat unit. In absence of any external force, the first chamber 3 is full of fluid. It is contemplated that the arrangement will have means allowing it to be removeably mounted to the seat unit. Said mounting means may be loops, strings, hoods, sheaths or other conventional means.

When the user sits on the chamber 3, the fluid contained therein becomes pressurised to a higher level than the fluid contained in the chambers 6 and 7. This pressure difference is transmitted by the sections 8*a* and 9*a* of the lines 8 and 9 and reaches the interior of each of the valve means 50 through the respective port 63. This causes the stopper 61 to bear against the first valve seat formed by the resilient washer 56 and therefore the valve remains closed, the pressure conditions in the chambers 6 and 7 remaining unaltered.

When the user wishes to change the conditions in one of the chambers 6 or 7, he operates the corresponding button 81 and moves the cable 78 longitudinally, against the force of spring 82. The ball end 79 of said cable bears against the end of the resilient hood member 71 which penetrates in the central orifice 57 of the washer 56, separating the stopper from the valve seat. In this way direct communication is established through the corresponding section 8*b* or 9*b* between the chamber 3 and the other chamber elected by the user. When the user considers that the corresponding chamber conditions are appropriate (namely, that an anatomical adaptation has taken place between the chamber and the user), he ceases to operate the button 81, whereby the force of spring 82 and also of the hood member 71 cause the end of the hood member to cease to bear against the stopper and the valve closes again, on reseating of the stopper 61 against the seat 56. It should be pointed out that for operation the arrangement only needs the weight of the user.

When the user ceases to sit on the seat unit 2, it is obvious that the pressure in the chamber 3 diminishes and becomes lower than that existing in the chambers 6 and 7. This higher pressure in said chambers causes the stopper 61 to seat against the second valve seat formed by the washer 59 also closing the valve means 50, whereby the conditions established when the user first sat down are maintained.

Notwithstanding, if it is desired to return to the initial state, it is sufficient to operate the opening means 84 by way of the knob 95. By pushing this knob the rod 91 is moved axially and thereby the end of the resilient hood 71 until the latter penetrates in the central orifice 60 of the washer 59, separating the stopper 61 from the valve seat. Under these circumstances, communication is established between the corresponding backrest chamber and the chamber 3.

If, furthermore, it is desired to maintain such communication without having to continue pressing the knob 95, it is sufficient to rotate the rod when the radial arms 94 are within the plug 87, such that said arms are moved out of alignment with the radial slot 90.

The valve means described above is particularly advantageous when installed in a seat unit usually used by the same person. In this case, it will be advantageous for the user to maintain the conditions in the chambers 6 and 7 always the same, whereby only occasionally will he have to operate the second opening means by way of the knob 95.

Nevertheless, on many occasions, as happens in theatre stalls, waiting room seats, seats in public vehicles, etc., most frequently the same seat will be occupied successively by different users. In such case, it is preferable that each time a user leaves the seat, the arrangement should return to its initial state.

For this purpose, there is provided a simplified valve which has not been illustrated and which differs from the valve means 50 in that it does not have the washer 59 nor the second opening means 84. In said simplified valve means, when the overpressure caused by the user on the chamber 3 ceases, the stopper 61 moves away from the washer 56 on being urged by the pressure from the port 62. Since there is no other valve seat on which to bear, it does not interrupt the return communication between the chambers 6 and 7 and the chamber 3 and therefore the original conditions are effectively restored.

Said simplified valve is very easy to produce from the valve means 50, it only being necessary to remove the resilient washer 59 and the tubular member 85 from the valve means 50 and replace the tubular member 85 by a plug sealing the port left open by removal of the said tubular member 85.

What I claim is:

1. An arrangement for the distribution of pressurized fluid to a seat unit having a backrest and a seat area, comprising:

(a) a first fluid-containing chamber adaptable to the seat area of the seat unit so as to receive, at least in part, the user's weight;

(b) at least one inflatable chamber adaptable to the backrest;

(c) lines communicating between said first chamber; and each at least one backrest chamber; and (d) normally closed valve means connected to each of said lines, the valve means including (i) at least one opening means having an opening control and being positioned in the seat unit so as to be easily accessible to the user thereof, (ii) a valve body with two access ports to the interior thereof, (iii) at least one valve seat; and (iv) a stopper made from relatively lightweight material for bearing against each said valve seat, wherein the or each valve seat comprises a resilient washer positioned between the stopper and one of the access ports, and wherein the opening means is associated with each washer forming each valve seat, is capable of penetrating from the space opposite that occupied by the stopper in the washer orifice and preventing the stopper from seating against the valve seat, is partially housed in a sealed tubular member fixedly attached to the valve body and comprises a filiform member moveable in a longitudinal direction and a spring member urging the filiform member away from the washer orifice, the opening control causing such longitudinal movement.

2. The arrangement of claim 1, wherein the internal end portion of each opening means housed in the corresponding tubular member is covered with an elongate flexible hood member, an open end flange of which is inserted in a sealed fashion in the tubular member.

3. The arrangement of claim 2, wherein first and second valve seats are formed by respective resilient washers generally opposed to one another and located between said access ports, and wherein first and second opening means are associated respectively with the washers forming said first and second valve seats.

4. The arrangement of claim 2, wherein the first opening means further comprises a cable capable of limited relative movement in a sheath which leaves the end portions of the cable free, said cable having at the outer end thereof a control push button urged by a spring forming said spring member and said sheath is held in place by a perforated plug screwed into the free end of the tublar member and having a fixed axial clamp-like projection to which there is adjustably mounted a second clamp member.

5. The arrangement of claim 2, wherein a second opening means is provided, comprising:

(a) a rod having an end covered by said flexible hood member, (b) a disc for recieving in the center thereof said rod, (c) a pair of opposed radial arms and a control knob, wherein the rod is capable of rotation relative to the corresponding tubular member, and the tubular member has a threaded plug provided in the free end thereof with a slot allowing the passage of said radial arms, while said disc is housed within said plug.

6. The arrangement of claim 2, comprising: a single valve seat formed by a resilient washer, wherein the opening means includes a cable mounted for limited relative movement in a sheath which leaves the end portions of the cable free, said cable having at the outer end thereof a control push button urged by a spring forming said spring member and said sheath is held in place by a perforated plug screwed into the free end of the tubular member and having a fixed axial clamp-like projection to which there is adjustably mounted a second clamp member.

7. The arrangement of claim 1, wherein there are two inflatable chambers in the backrest area, one of them for supporting the user's back and the other for supporting the user's cervical region.

8. The arrangement of claim 1, wherein said first chamber is resilient and tends to recover and maintain the volume it occupied when not subject to the user's weight.

9. The arrangement of claim 1, further comprising means for allowing the arrangement to be releasably mounted to a seat means having a backrest.

* * * * *